United States Patent [19]

Iwahashi

[11] Patent Number: 4,669,855

[45] Date of Patent: Jun. 2, 1987

[54] ELECTROPHOTOGRAPHIC APPARATUS FOR OBTAINING VISIBLE IMAGES BY IRRADIATION OF AN AMORPHOUS SILICON PHOTOSENSITIVE MEMBER AND METHOD THEREFORE

[75] Inventor: Haruo Iwahashi, Hachioji, Japan

[73] Assignee: Konishiroku Photo Industry Co., Ltd., Tokyo, Japan

[21] Appl. No.: 715,533

[22] Filed: Mar. 25, 1985

[30] Foreign Application Priority Data

Mar. 28, 1984 [JP] Japan ..... 59-59726
Mar. 28, 1984 [JP] Japan ..... 59-59727

[51] Int. Cl.[4] ..... G03G 15/00

[52] U.S. Cl. ..... 355/3 R; 355/77; 430/31

[58] Field of Search ..... 355/3 R, 15, 77, 67; 430/31, 97, 104

[56] References Cited

U.S. PATENT DOCUMENTS 4,035,750 7/1977 Staudenmayer et al. ..... 355/15 X
4,592,643 6/1986 Higashiguchi et al. ..... 355/3 R

*Primary Examiner*—R. L. Moses
*Attorney, Agent, or Firm*—Jordan B. Bierman

[57] ABSTRACT

An image forming apparatus and method having a series of cycles for obtaining a visible image by forming an electrostatic image on a photosensitive member of amorphous silicon and by developing the electrostatic image by irradiating the surface of the photosensitive member for each image forming cycle with a light having wavelength longer than 600 nm and containing substantially no rays having wavelengths of 550 to 600 nm.

16 Claims, 4 Drawing Figures

ELECTROPHOTOGRAPHIC APPARATUS FOR OBTAINING VISIBLE IMAGES BY IRRADIATION OF AN AMORPHOUS SILICON PHOTOSENSITIVE MEMBER AND METHOD THEREFORE

BACKGROUND OF THE INVENTION

1. Field of the Invention

The present invention relates to an image forming apparatus such as an electrophotographic copying machine.

2. Description of the Prior Art

In the image forming apparatus such as the electrophotographic copying machine, there is used a photosensitive member which is prepared by forming a photoconductive layer of selenium-tellurium or amorphous silicon on a conductive substrate, and there are repeated cycles each of which includes the steps of charging all over surface of the photosensitive member, subjecting the charged photoconductive member to an image forming exposure to form an electrostatic image, developing the electrostatic image with toner to convert it into a toner image, and transferring the toner image attained to a transfer material such as paper to attain an image record. After the transfer of the toner image, the photosensitive member is cleared for reuse by removing a residual toner by means of a cleaning means. However, the charges are still left on or in surface of the photosensitive member so that they have to be removed before the photosensitive member is used again.

In order to neutralize the charges on the surface of the photosensitive member, there is currently adopted a method of exposing all over the surface of the photosensitive member. If the exposures are repeated, however, there appears a phenomenon that the charged potential of the photosensitive member is dropped by the influences of the repetition of the whole-surface exposures.

In the electrophotographic copying machine of the prior art such as a copying machine using a photosensitive member of selenium-tellurium, this photosensitive member can have its charge generating layer of selenium-tellurium of a relatively large thickness (e.g., about 60 microns) so that it can be charged at a high level of 700 to 1,000 V. The refer, even with the drop ($\Delta V$: usually equal to or lower than 70 V) of the charged potential during the repeated uses, the resultant changing rate of the charged potential is relatively low.

In the photosensitive member made of amorphous silicon (which will be shortly referred to as an "a-Si"), however, the a-Si charge generating layer to be formed is usually limited to a small thickness, e.g., 15 to 30 microns by the problems of its film forming technique or the mobility of the charge carriers (or shortly "carriers"). As a result, the potential to be able to charged (or shortly "charged potential") is about 300 to 600 V at the highest so that the changing rate of the charged potential is made liable to take a large value due to the dropping ($\Delta V$) of the charged potential. In order to form an image of high quality, therefore, it is indispensable to hold the dynamic range of the developing bias wide for the development and to stabilize the charged potential during the repeated uses. Especially in the a-Si photosensitive member, moreover, it is necessary to consider countermeasures for preventing the phenomenon called the "ghost" which is based upon fatigues due to the optical irradiation. This ghost is a phenomenon that the fatigues of the photosensitive member are made locally different or advanced by the ununiformity of the optical irradiation to leave a negative or positive image even during a subsequent copy operation so that a desired image cannot be attained (for example, the aforementioned left image appears with a high density in a halftone image).

Incidentally, there are present in the prior art a variety of techniques using the a-Si photosensitive member, all of which have failed to satisfy the aforementioned requirements. In Japanese Patent Laid-Open No. 58-62659, for example, there is disclosed a technique in which the photosensitive member is irradiated with a ray of short wavelength lower than 600 nm as an optical ray for exposures and/or charge neutralizations. However, we found that the ghost is made liable to occur by the wavelength component of 550 nm or shorter of that short-wavelength ray and that the wavelength component of 550 to 600 nm does not always improve the repetition characteristics (i.e., the changing rate of the charged potential for the repeated uses). In the above-specified Laid-Open, moreover, there is also disclosed a concept that the aforementioned ray may contain a component of the longer-wavelength than 600 nm having an energy distribution ratio of 30% or smaller. As tne ratio of the longer-wavelength component, is too small, it is impossible to expect improvements in the repetition characteristics.

SUMMARY OF THE INVENTION

An object of the present invention is to provide an image forming apparatus such as an electrophotographic copying machine which can effectively realize both stabilization of the charged potential after repeated uses of a photoconductive member and prevention of ghosts.

The above-specified object is achieved by an image forming apparatus having an image forming cycle for obtaining a visible image by forming an electrostatic image on a photosensitive member of amorphous silicon and by developing said electrostatic image, comprising means for irradiating the whole surface of said photosensitive member for each said image forming cycle with an optical ray which contains a ray having a longer-wavelength than 600 nm but does hot relatively contain essentially a ray having a wavelength of 550 to 600 nm.

DETAILED DESCRIPTION OF THE INVENTION

First of all, the development, in which I have examined a variety of charge erasing light sources and have reached the present invention on the basis of the examined results.

Figure 1:
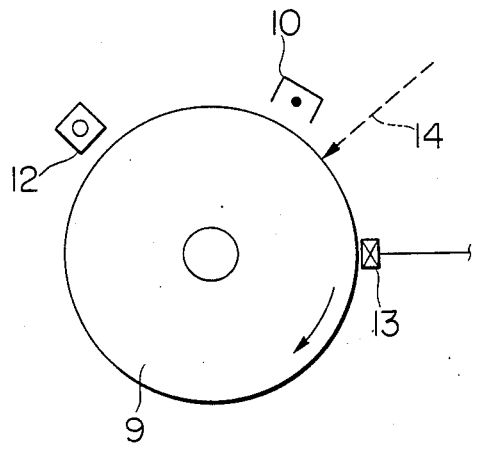
FIG. 1 is a schematic view showing an essential portion of an apparatus to be used for measuring the charge potential of a photosensitive member.

FIG. 1 shows the essential portion of the apparatus which has been used for the tests. The apparatus is constructed such that a charge erasing light source 12, a corona charger 10 and a surface potentiometer 13 are arranged around a rotatable photo-sensitive drum 9 (e.g., the a-Si photosensitive member illustrated in FIG. 1 is as follows; Containing a hydrogen H.

The thickness of the layer thereof: 20±1 μm;

Charged potential: 740 V at 70 μA of charged current;

Residual potential: Not higher than 10 V;

White-light sensitivity: 0.3 Lux-sec. that is, a light-quantity requires for reducing a voltage from the initial 450 V down to one half; and Dark-attenuation constant: 0.82 in a state 3 seconds after the initial stage of 450 V.) so that a reflected ray 14 from a document (although not shown) may be incident upon the drum 9 at the back of the charger 10.

Figure 2:
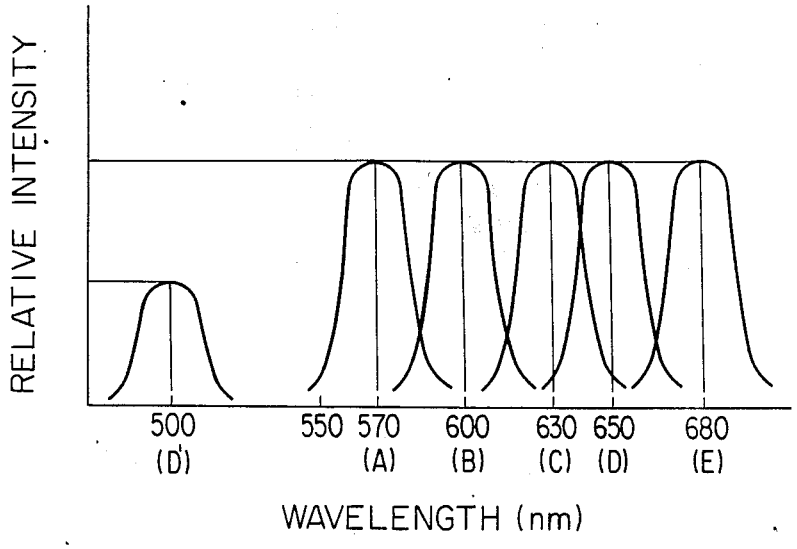
FIG. 2 is a diagram showing the energy distributions of respective peak wavelengths.

Light emitting elements for emitting optical rays having wavelength distributions, as shown at A, B, C, D, D+D', and E (all of these lamps are fluorescent lamps made by TOSHIBA ®) in FIG. 2, were used as the charge erasing light source, and the resultant effects were compared. The drum 9 was exposed by means of the respective lamps, and the exposures were repeated 100 times for each lamp. The drops (ΔV) in the charge potential of the photosensitive members before and after each repetition were obtained in accordance with the document density, as enumerated in the following Table-1. Incidentally, the initial potentials ($V_0$) were set at 500 V, 250 V and 50 V for the document densities 1.3, 0.3 and 0.0, respectively, and the emissions of the charge erasing lamps were set at 10 to 20 luxes second.

TABLE 1

| Lamp | | Charge Potential Drop ΔV (Potential Changing Rate $\Delta V/V_0$) Document Density | | |
|---|---|---|---|---|
| Kind | Peak Wavelength | 1.3 | 0.3 | 0.0 |
| A (FL 2S-WWA) | 570 nm | −35 V (7%) | −30 V (12%) | −20 V (40%) |
| B (FL 2S.Pk) | 600 nm | −85 V (17%) | −85 V (34%) | −15 V (30%) |
| C | 630 nm | −15 V (3%) | −35 V (14%) | −15 V (30%) |
| D | 650 nm | −10 V (2%) | −30 V (12%) | −15 V (30%) |
| D + D' (FL 2S-BRF) | 650 nm + 500 nm | −5 V (1%) | −30 V (12%) | −5 V (10%) |
| E | 680 nm | −8 V (1.6%) | −28 V (11.2%) | −15 V (30%) |

Figure 3:
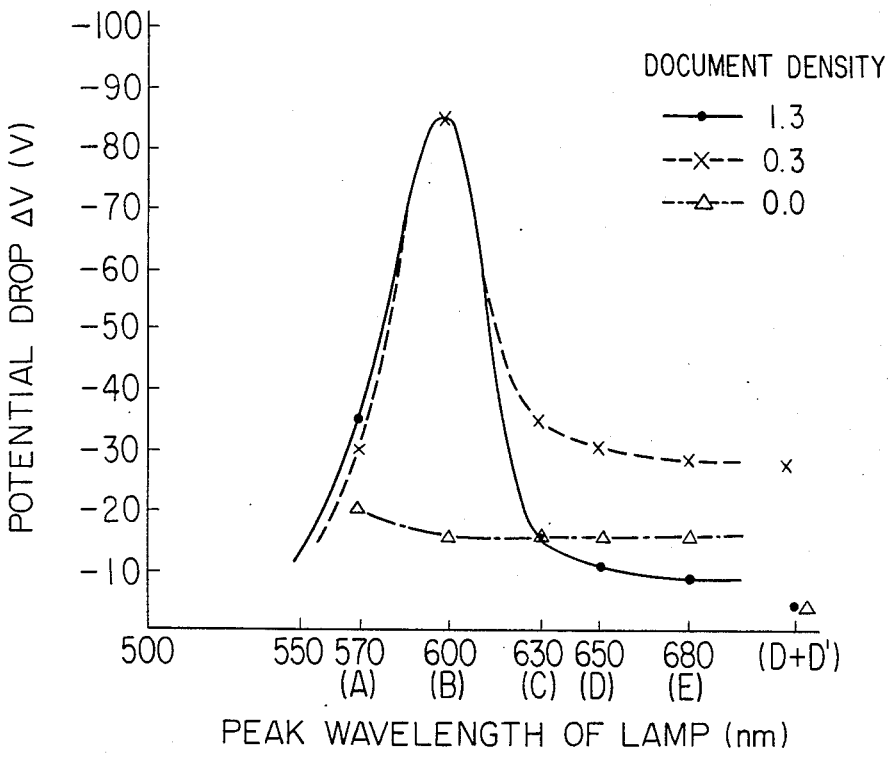
FIG. 3 is a graph plotting the charged potential drops against the peak wavelength of used lamp relating to table-1.

As is apparent from the above results, it was found that the charge potential drop or changing rate for each document density was far lower, in case the rays (C, D and E) having a light of the wavelength >600 nm, especially, ≧630 nm were used, than in the case of the wavelength ≦600 nm, and that the values ΔV and $\Delta V/V_0$ were far lower if the rays composed mainly of the ray (D) having a wavelength of 650 nm and the rays (having two wavelength components superposed) having two peaks and containing the ray (D') of wavelength 500 nm were used. In FIG. 3, the charge potential drops ΔV for the respective frequency components are plotted for each understanding. It will be understood in view of FIG. 3 that the aforementioned tendencies are prominent.

Moreover, the ray of the lamp B had its component of wavelength equal to shorter than 600 nm cut by means of a filter on the basis of the aforementioned results, and the charge erasures were conducted. It was then confirmed that the potential drops were remarkably reduced, as enumerated in the following Table- 2.

TABLE 2

| | Charge Potential Drop ΔV (Potential Changing Rate $\Delta V/V_0$) Document Density | | |
|---|---|---|---|
| | 1.3 | 0.3 | 0.0 |
| Lamp B | −85 V (17%) | −85 V (34%) | −15 V (30%) |
| Lamp B (wavelength lower than 600 nm is cut) | −15 V (3%) | −45 V (18%) | −15 V (30%) |

It was made apparent from the above results that the potential could be held stably during the repeated uses by using the ray having wavelength >600 nm as that for erasing the charges of the photosensitive member and that the more better results could be attained by using the ray having a wavelength <550 nm together with the ray having a wavelength >600 nm. As is apparent from FIG. 3, too, it was confirmed that the irradiation of the whole surface with the ray having a wavelength of 550 nm to 600 nm undesirably augmented the potential drop to a remarkably extent.

It is desirable to use the ray having a wavelength ≧630 nm, more preferably, ≧650 nm as the ray having a wavelength >600 nm. Since the a-Si photosensitive member has a high sensitivity in the neibourhood of 680 nm, moreover, the ray having the wavelength within the above-specified range is remarkably preferably for the charge erasure of the a-Si photosensitive member.

As the light source of the ray having the above-specified wavelength >600 nm, there can be used either a light emitting element having a narrow light emitting band such as a light emitting diode having a light emitting peak in the region >600 nm, or a light source in which a light emitting element having a wide light emitting band including a ray >600 nm such as an incandescent lamp is used with a filter for absorbing a ray having a wavelength ≦600 nm. As the light source containing the ray >600 nm and the ray <550 nm, on the other hand, there can be used together a light emitting element having a narrow light emitting band, which has a light emitting peak in a range >600 nm, and a light emitting element such as a light emitting diode which has a light emitting peak in a range <550 nm. Likewise, there may be used a light source in which a light emitting element such as the incandescent lamp having wide ranges >600 nm and <550 nm is used with a filter for absorbing a ray having a band of 550 nm to 600 nm. Alternatively, there can be used a single light emitting element which has light emitting peaks in the ranges >600 nm and <550 nm.

Figure 4:
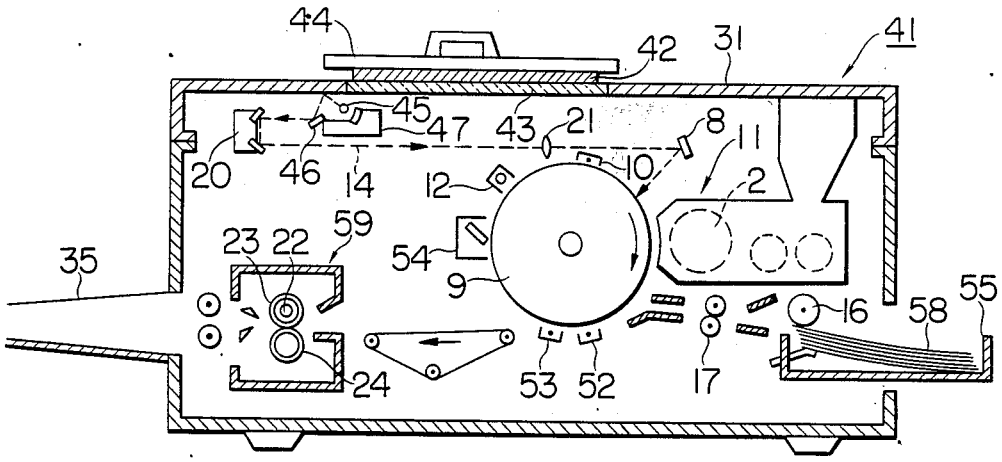
FIG. 4 is a schematic section showing an electrophotographic copying machine.

FIG. 4 shows an example of the electro-photographic copying machine according to the present invention, in which the photosensitive drum 9 having the a-Si photosensitive layer is built. In this copying machine 41, there are arranged in the upper portion of a cabinet 31 both a document table 43 for placing a document 42 thereon and a platen cover 44 for covering the document 42. Below the document table 43, there is so disposed an optical scanning carriage which is composed of a light source 45 and a first mirror unit 47 having a first reflecting mirror 46 that it can move linearly to the right and left of FIG. 4. A second mirror unit 20 for making constant the length of the optical path between the document scanning point and the photosensitive member is moved in accordance with the speed of the first mirror unit so that the reflected ray 14 from the document table 43 may be formed into a slit shape to enter the photosensitive drum 9 acting as the image carrier. Around the drum 9, there are arranged the corona charger 10, a developer 11 having a developing sleeve 2 therein, a transfer unit 52, a separating unit 53, a cleaning unit 54, and the whole-surface exposing light source 12 for the charge erasure. Sheets of copy paper 58 supplied from a paper supply box 55 through paper feed rollers 16 and 17 have the toner image of the drum 9 transferred thereto and are then fixed with the toner image by a fixing unit 59 until they are discharged to a tray 35. In the fixing unit 59, the copy paper developed is fixed while passing through a heating roll 23 having a heater 22 therein and a pressure roll 24.

As the whole-surface exposing light source 12, there is used the aforementioned light source for emitting the ray having the wavelength >600 nm or the wavelengths >600 nm and <550 nm according to the present invention.

By using the copying machine thus constructed, the electrophotographic process was actually executed to form the image while varying the ray of the whole-surface exposing light source together with the light source for comparisons. By observing the occurring status of the aforementioned ghosts, it was found, as enumerated in the following Table-3, that the occurrence of the ghosts was prominent in the case of the light source A having the peak wavelength of 570 nm and used for the comparison but was remarkably reduced in case the whole-surface exposure was conducted by using the light sources (B to E) having the wavelength >600 nm or the light sources (D+D') having the wavelengths >600 nm and <550 nm according to the present invention.

TABLE 3

| | Peak Wavelengths of Light Sources | | | | | | |
|---|---|---|---|---|---|---|---|
| | A | B | C | D | D + D' | | E |
| Judgement of Ghost | x | ○ | ◎ | ◎ | ◎ | ◎ | ◎ |

In the above Table-3: symbol x designates that the ghosts are prominent; symbol O designates that the ghosts raise no practical problem; and symbol ◎ designates that the ghosts are hardly generated.

The foregoing results reveal that the use of the ray having the peak in the wavelength >600 nm, especially, ≧630 nm, preferably, ≧650 nm for the whole-surface exposure will be remarkably effective for the repeated uses and for the ghost prevention, and that better effects can be attained by using the ray having the peak in the aforementioned range >600 nm together with the ray having the peak in the range <550 nm. In case the rays having the wavelengths >600 nm and <550 nm are used together, it is desired that the energy ratio of the ray wavelength component [D] of not less than 600 nm of the rays emitted from lamp D and the ray wavelength component [D'] of not more than 550 nm of the rays emitted from lamp D' be expressed by 30 (%) <[D]/([D]+[D'])≦90 (%) (e.g., 67% in the aforementioned example).

The causes for the aforementioned results are thought to come from that, since the ray for the whole exposure is composed mainly of the longer-wavelength component ≧600 nm, especially the a-Si photosensitive member fatigues all over its surface so that its local fatigue is reduced.

In case the ray ≦550 nm is used together, it is also thought that the shorter-wavelength component is liable to be absorbed by the surface of the photosensitive member, because it has a high absorption coefficient, so that the actions of those two wavelength components are suitably multiplied.

Although the present invention has been exemplified hereinbefore, the aforementioned embodiment can be further modified in accordance with the technical concept of the present invention.

For example, any ray having two or more peaks in each range can be used if it has peaks in the wavelengths ≧600 nm and ≦550 nm, respectively. Moreover, the present invention can also be applied to another copying or recording machine such as an apparatus using a chromatic copying or screen photosenstive member.

In the image forming apparatus according to the present invention, as has been described hereinbefore, the fatigue of the photosensitive member can be reduced to realize safety of the charge potential for repeated uses and the prevention of the ghosts.

What is claimed is:

1. An image forming apparatus having an image forming cycle for obtaining a visible image by forming an electrostatic image on a photosensitive member of amorphous silicon and by developing said electrostatic image, comprising means for irradiating the surface of said photosensitive member for each said image forming cycle with a light having a wavelength longer than 600 nm but containing substantially no ray having a wavelength of 550 to 600 nm.

2. An image forming apparatus according to claim 1 wherein said light consists essentially of a wavelength longer than 600 nm.

3. An image forming apparatus according to claim 1 wherein said light has a wavelength longer than 600 nm and a wavelength shorter than 550 nm.

4. An image forming apparatus according to claim 1 wherein said light is emitted before the formation of the electrostatic image in said image forming cycle.

5. An image forming apparatus according to claim 2 wherein the source of said light includes a light emitting element having a light emitting peak equal to or longer than 630 nm.

6. An image forming apparatus according to claim 2 wherein the source of said light comprises a light emitting element for emitting a ray having a wavelength equal to or longer than 600 nm and a filter for absorbing wavelengths equal to or shorter than 600 nm.

7. An image forming apparatus according to claim 2 wherein the source of said light includjes a light emitting element having light emitting peaks in wavelengths shorter than 550 nm and longer than 600 nm.

8. An image forming apparatus according to claim 7 wherein the source of said light includes a light emitting element having light emitting peaks in wavelength equal to 500 or shorter than 500 nm and equal to or longer than 650 nm.

9. An image forming apparatus according to claim 8 wherein said element emits light having a minimum point at a wavelength longer than 500 nm and shorter than 650 nm.

10. An image forming apparatus according to claim 7 wherein said source includes a light emitting element having a light emitting peak at a wavelength equal to or shorter than 550 nm and a light emitting element having a light emitting peak at a wavelength equal to or longer than 600 nm.

11. An image forming apparatus according to claim 10 wherein said element emits light having a minimum point in wavelengths longer than 550 nm and shorter than 600 nm.

12. An image forming apparatus according to claim 3 wherein the source of said light includes an element emitting light containing wavelengths equal to or shorter than 550 nm and equal to or longer than 600 nm, and a filter for absorbing wavelengths of 550 nm to 600 nm.

13. An image forming apparatus according to claim 4 wherein the source of said light includes a light emitting element having light emitting peaks at wavelengths equal to or shorter than 550 nm and equal to or longer than 600 nm.

14. An image forming apparatus according to claim 4 wherein said light source includes an element for emitting light containing rays having wavelengths equal to or shorter than 550 nm and equal to or longer than 600 nm, and a filter for absorbing wavelengths of 550 nm to 600 nm.

15. An image forming apparatus according to claim 4 wherein the ratio of the energy of rays of said light having a wavelength equal to or longer than 600 nm to the sum of the energies of the rays having wavelengths equal to or longer than 600 nm and equal to or shorter than 550 nm is 30% to 90%.

16. An image forming method having a series of image forming cycles including the steps of exposing the surfaces of a photosensitive member of amorphous silicon to form an electrostatic image at an image forming exposure region, developing the electrostatic image to form a toner image, transferring said toner image to another transfer member, and followed by another image forming step, said method comprising irradiating said region with light comprising a ray having a wavelength equal to or longer than 600 nm but substantially eliminating wavelengths of 550 nm to 600 nm, whereby said irradiating takes place during each said image forming cycle.

* * * * *